US008970437B2

(12) United States Patent
Hirabayashi

(10) Patent No.: US 8,970,437 B2
(45) Date of Patent: Mar. 3, 2015

(54) ELECTRONIC DEVICE

(75) Inventor: Takayuki Hirabayashi, Tokyo (JP)

(73) Assignee: Sony Corporation (JP)

( * ) Notice: Subject to any disclaimer, the term of this patent is extended or adjusted under 35 U.S.C. 154(b) by 724 days.

(21) Appl. No.: 12/661,395

(22) Filed: Mar. 16, 2010

(65) Prior Publication Data

US 2010/0238074 A1 Sep. 23, 2010

(30) Foreign Application Priority Data

Mar. 23, 2009 (JP) ..... P2009-070071

(51) Int. Cl.
*H01Q 1/24* (2006.01)

(52) U.S. Cl.
USPC ..... 343/702

(58) Field of Classification Search
CPC ..... H01Q 1/24; H01Q 1/38; H01Q 9/0421; H01Q 1/244; H01Q 1/242
USPC ..... 343/702, 700 MS, 815
See application file for complete search history.

(56) References Cited

U.S. PATENT DOCUMENTS

| | | | | |
|---|---|---|---|---|
| 6,924,769 | B2 * | 8/2005 | Ito et al. | 343/702 |
| 7,026,999 | B2 * | 4/2006 | Umehara et al. | 343/702 |
| 7,450,070 | B2 * | 11/2008 | Chang et al. | 343/700 MS |
| 7,746,286 | B2 * | 6/2010 | Suzuki | 343/833 |
| 7,982,678 | B2 * | 7/2011 | Hotta et al. | 343/702 |
| 2002/0190905 | A1 * | 12/2002 | Flint et al. | 343/702 |
| 2003/0222823 | A1 * | 12/2003 | Flint et al. | 343/702 |
| 2005/0110692 | A1 * | 5/2005 | Andersson | 343/702 |
| 2006/0232481 | A1 | 10/2006 | Hilgers | |

FOREIGN PATENT DOCUMENTS

| | | | |
|---|---|---|---|
| JP | 2006020136 | A | 1/2006 |
| JP | 2007503149 | A | 2/2007 |
| JP | 4047283 | B2 | 2/2008 |

* cited by examiner

*Primary Examiner* — Huedung Mancuso
(74) *Attorney, Agent, or Firm* — Lerner, David, Littenberg, Krumholz & Mentlik, LLP

(57) ABSTRACT

An electronic device includes: a circuit substrate; and an antenna element installed on the circuit substrate, wherein the antenna element is installed at a position apart from an end of the circuit substrate by a given offset so that distribution variation of irradiation characteristics of the antenna element within a horizontal surface is reduced both in cases where the electronic device in which the antenna element is installed is set in portrait orientation and in landscape orientation.

12 Claims, 9 Drawing Sheets

ELECTRONIC DEVICE

CROSS-REFERENCE TO RELATED APPLICATION

The present application claims priority from Japanese Patent Application No. JP 2009-070071 filed in the Japanese Patent Office on Mar. 23, 2009, the entire content of which is incorporated herein by reference.

BACKGROUND OF THE INVENTION

1. Field of the Invention

The present invention relates to an electronic device, and particularly relates to an electronic device capable of reducing the difference of radiation characteristics of an antenna element in cases where the device is used in portrait orientation and in landscape orientation.

2. Description of the Related Art

A wireless communication function is generally mounted on communication devices such as a personal computer, a cellular phone device, a PDA (Personal Digital Assistant). In recent years, the wireless communication function is also mounted on consumer electronic devices other than communication devices, for example, an audio device, a video device, a camera device, a printer, an entertainment robot, a digital photo frame and so on.

As a wireless communication system, for example, there exists a narrowband wireless communication system using a 5.2 GHz band carrier wave which is proposed in IEEE (Institute of Electrical and Electronic Engineers) 802.11a. There are also a wireless LAN (Local Area Network) system, a near-field wireless communication system which is called as Bluetooth (Trademark) using 2.4 GHz band carrier wave which is proposed in IEEE 802.11b, IEEE802.11 using a MIMO (Multiple Input Multiple Output) system for obtaining a high transmission rate and the like.

In electronic devices larger than a cellular phone device such as a notebook personal computer in electronic devices having the wireless communication function, an antenna element for wireless communication is commonly installed at a corner of a casing (for example, refer to JP-T-2007-503149, JP-A-2006-20136 and Japanese Patent No. 4047283 (Patent Documents 1 to 3)). This is because, when the antenna element is installed at the corner, interference with respect to peripheral components inside the electronic device is reduced and a portion secured for free space is increased, as a result, gain improvement can be expected.

In electronic devices having the wireless communication function, there exists an electronic device which can be used both in portrait orientation and in landscape orientation such as a digital photo frame, in which display is performed so as to be viewed by a user in a normal position when the device is set in portrait orientation as well as in landscape orientation.

In such electronic device, it is necessary that a large difference does not occur in radiation characteristics of the antenna element when used in respective orientations.

SUMMARY OF THE INVENTION

However, in electronic devices having the wireless communication functions, the reduction of difference in radiation characteristics of the antenna element when used in portrait orientation and in landscape orientation has not been considered.

Thus, it is desirable to reduce the difference in radiation characteristics of the antenna element when used in portrait orientation and in landscape orientation.

According to an embodiment of the present invention, there is provided an electronic device including a circuit substrate and an antenna element installed on the circuit substrate, in which the antenna element is installed at a position apart from an end of the circuit substrate by a given offset so that distribution variation of irradiation characteristics of the antenna element within a horizontal surface is reduced both in cases where the electronic device in which the antenna element is installed is set in portrait orientation and in landscape orientation.

In the embodiment of the present invention, the antenna element is installed at a position apart from the end of the circuit substrate by a given offset so that distribution variation of irradiation characteristics of the antenna element within the horizontal surface is reduced both in cases where the electronic device in which the antenna element is installed is set in portrait orientation and in landscape orientation.

According to another embodiment of the present invention, there is provided a electronic device including a circuit substrate and an antenna element installed on the circuit substrate, in which the antenna element is installed at a position apart from an end of the circuit substrate by a given offset so that the difference of average values in distribution of irradiation characteristics of the antenna element within a horizontal surface is reduced in cases where the electronic device in which the antenna element is installed is set in portrait orientation and in landscape orientation.

In this embodiment of the present invention, the antenna element is installed at a position apart from the end of the circuit substrate by the given offset so that the difference of average values in distribution of irradiation characteristics of the antenna element within the horizontal surface is reduced to the maximum in cases where the electronic device in which the antenna element is installed is set in portrait orientation and in landscape orientation.

According to still another embodiment of the present invention, there is provided an electronic device including a circuit substrate and an antenna element installed on the circuit substrate, in which the antenna element is installed at a position apart from an end of the circuit substrate by a given offset so that distribution of irradiation characteristics of the antenna element in all directions comes close to a true sphere.

According to this embodiment of the present invention, the antenna element is installed at a position apart from the end of the circuit substrate by the given offset so that distribution of irradiation characteristics of the antenna element in all directions comes close to a true sphere to the maximum degree.

As described above, according to the embodiments of the present invention, it is possible to reduce the difference in irradiation characteristics of the antenna element in cases where the antenna element is used in portrait orientation and in landscape orientation.

DESCRIPTION OF THE PREFERRED EMBODIMENTS

Embodiment

[Configuration Example of an Embodiment of a Liquid Crystal Display Device]

Figure 1A:
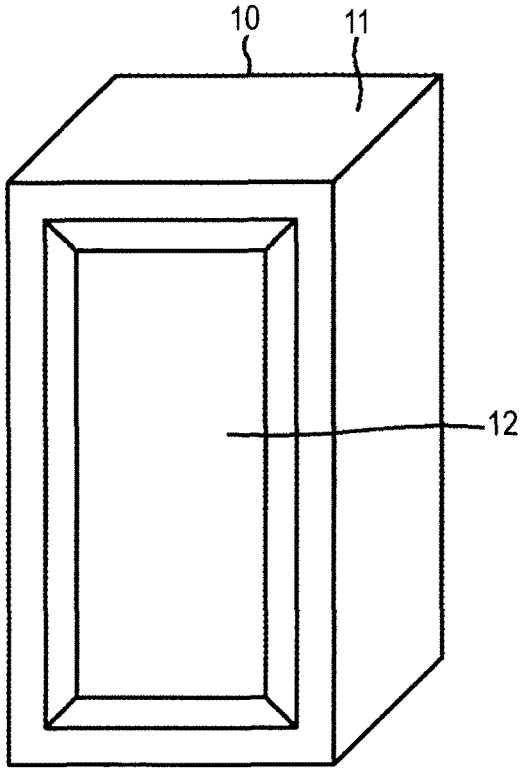
FIG. 1A and FIG. 1B are perspective views showing appearance of an embodiment of a liquid crystal display device to which the present invention is applied.
Figure 1B:
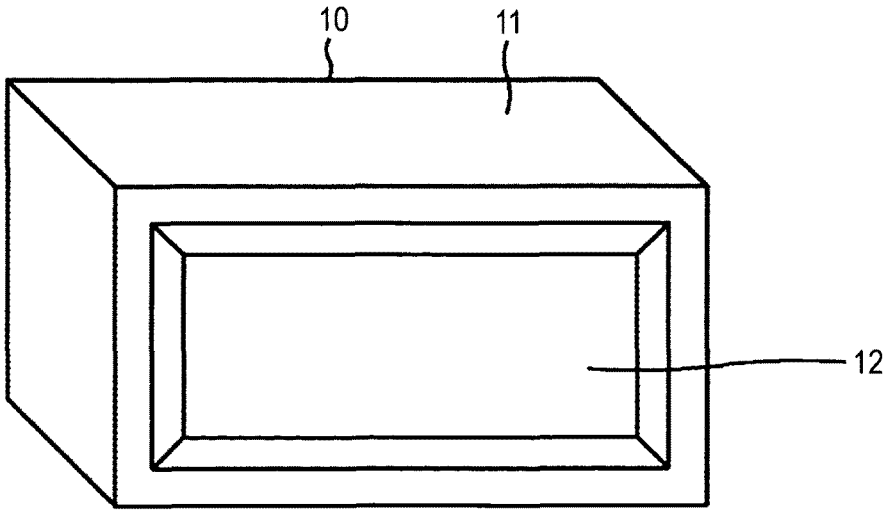

FIG. 1A and FIG. 1B are perspective views showing appearance of an embodiment of a liquid crystal display device to which the present invention is applied.

A liquid crystal display device 10 in FIG. 1A and FIG. 1B is a so-called digital photo frame, which includes a rectangular parallelepiped casing 11, a liquid crystal display arranged on a given surface of the rectangular parallelepiped and the like.

The liquid crystal display device 10 can be used by being set so that a display area of the liquid crystal display 12 is longer than is wide (refer to a portrait orientation in the following description) as shown in FIG. 1A. The liquid crystal display device 10 can be also used by being set in an orientation so that the display area of the liquid crystal display 12 is long sideways (refer to a landscape orientation in the following description) as shown in FIG. 1B.

The liquid crystal display device 10 includes an antenna for performing wireless communication with other electronic devices. The liquid crystal display device 10 acquires image data by wireless communication using the antenna and displays images on the liquid crystal display 12 in an orientation corresponding to the orientation of the device itself. Specifically, the liquid crystal display device 10 displays images in the orientation which can be viewed by the user in the normal position.

[Configuration Example of an Antenna]

Figure 2:
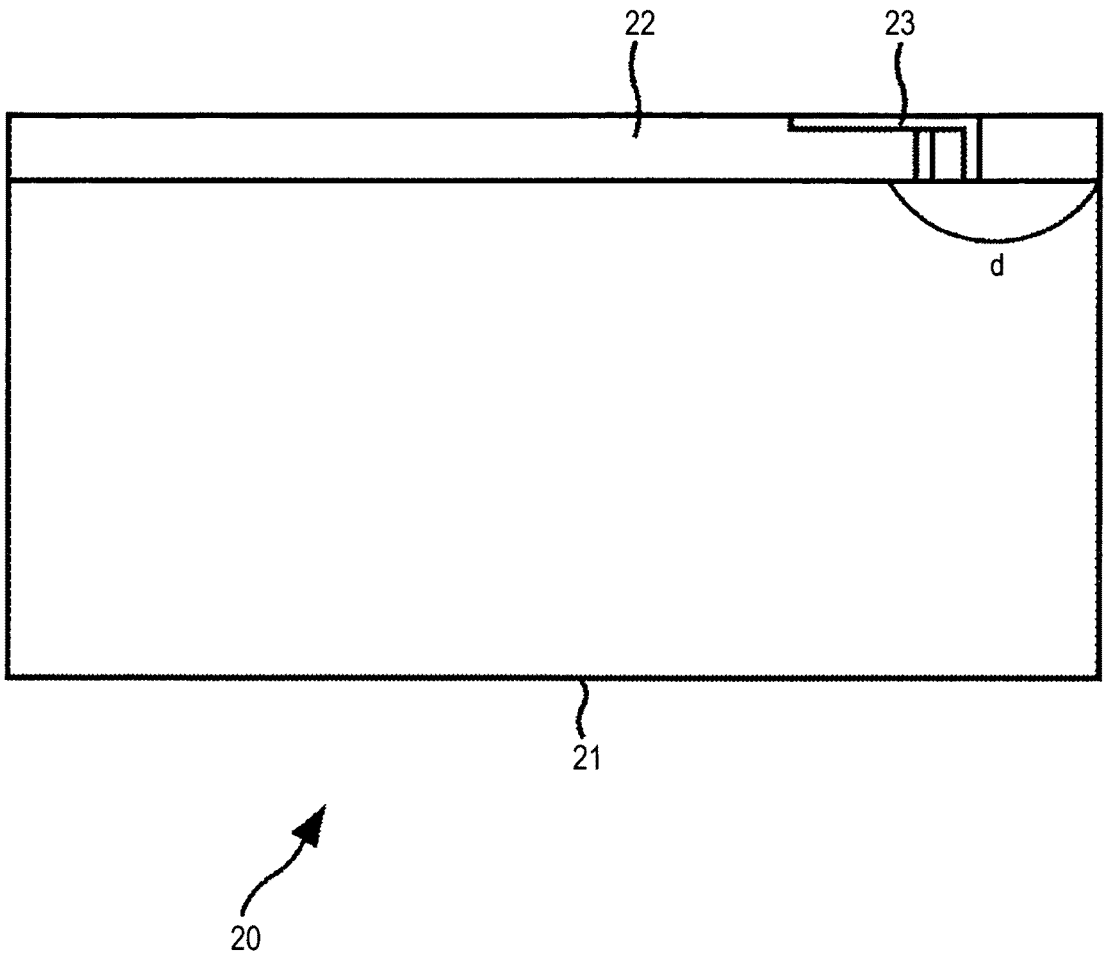
FIG. 2 is a view showing an outline configuration of an antenna.

FIG. 2 is a view showing an outline configuration of an antenna 20 included in the liquid crystal display 10 seen from a direction vertical to a setting surface on which the liquid crystal display 12 when the liquid crystal display device 10 is set in landscape orientation.

As shown in FIG. 2, the antenna 20 includes a bottom plate 21, a dielectric circuit substrate 22 installed on the bottom plate 21 and an antenna element 23 arranged on the circuit substrate 22.

The antenna element 23 resonates at a single frequency and arranged so that the center of the antenna element 23 is on a position apart from the upper right end of the circuit substrate 22 by a given offset "d". As the antenna element 23, a monopole antenna, a reverse F-type antenna, a reverse L-type antenna, a folded monopole antenna, a slot antenna and so on can be used.

The offset "d" is determined so that the difference in irradiation characteristics of the antenna 23 in cases where the liquid crystal display device 10 is used in portrait orientation and in landscape orientation is reduced. The offset "d" can be calculated by performing electromagnetic field analysis.

[Explanation of a Method of Determining the Offset]

Figure 3A:
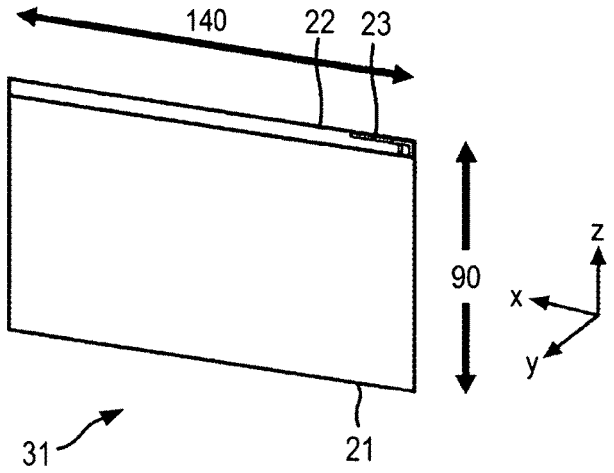
FIG. 3A to FIG. 3C are configuration examples of antennas used in electromagnetic field analysis.
Figure 3B:
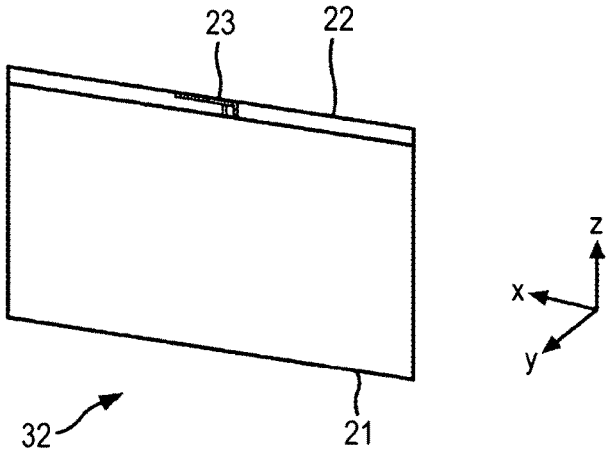
Figure 3C:
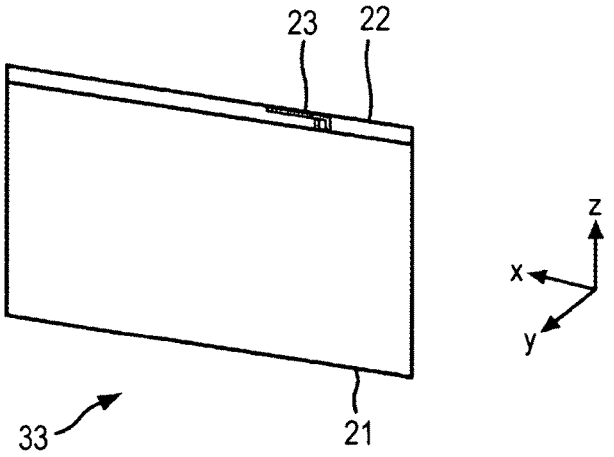

FIG. 3A to FIG. 3C show configuration examples of antennas used in the electromagnetic field analysis for calculating the offset "d".

As shown in FIG. 3A, an antenna in which the antenna element 23 is arranged at the upper right end, namely, an upper right corner of the circuit substrate 22 provided on the bottom plate 21 is applied as a first antenna 31 to be analyzed in the electromagnetic field analysis.

In the examples of FIG. 3A to FIG. 3C, the longitudinal length of the bottom plate 21 is 140 mm and the length vertical to the longitudinal direction is 90 mm. Hereinafter, the longitudinal direction is referred to as an x-direction the direction vertical to the longitudinal direction is referred to as a z-direction, and the direction vertical to the bottom plate 21 is referred to as a y-direction.

Also in the electromagnetic field analysis, as shown in FIG. 3B, an antenna in which the antenna element 23 is arranged at the upper center of the circuit substrate 22 provided on the bottom plate 21 is used as a second antenna 32 to be analyzed. Further as shown in FIG. 3C, an antenna in which the antenna element 23 is arranged at the center between the upper right end and the upper center of the circuit substrate 22 provided on the bottom plate 21 is used as a third antenna 33 to be analyzed.

The shape and size of the bottom plate 21 of the antennas 31 to 33 used for the electromagnetic field analysis are the same as the bottom plate 21 of the liquid crystal display device 10. The shape, size and type of the antenna elements 23 of the antenna 31 to 33 are also the same as the antenna element 23 of the liquid crystal display device 10.

In the following description, the orientation of the antennas 31 to 33 which is the same as the orientation of the antenna 20 in the case where the liquid crystal display device 10 is set in portrait orientation is referred to as a portrait orientation. Similarly, the orientation of the antennas 31 to 33 which is the same as the orientation of the antenna 20 in the case where the liquid crystal display device 10 is set in landscape orientation is referred to as a landscape orientation.

When the maximum gain and the irradiation efficiency of the antenna elements 23 in the case where the antennas 31 to 33 is set in landscape orientation are calculated by performing the electromagnetic field analysis, the maximum gain is 3.9 dB and the irradiation efficiency is −0.37 dB in the antenna 31. In the antenna 32, the maximum gain is 3.1 dB and the irradiation efficiency is −0.35 dB. In the antenna 33, the maximum gain is 3.4 dB and the irradiation efficiency is 0.82 dB.

According to the above, it can be found that the maximum gain of the antenna 31 is larger than these of the antenna 32 and the antenna 33. It can also be found that the irradiation efficiency of the antenna 33 is lower than these of the antenna 31 and the antenna 32. Therefore, in the existing electronic devices used in landscape orientation, the antenna element is arranged at the corner as the antenna 31 in many cases, considering the irradiation gain and the irradiation efficiency.

FIG. 4A to FIG. 4C and FIG. 5 are views showing distribution of irradiation characteristics of the antenna elements 23 within a horizontal surface (yz-surface) in the case where the antennas 31 to 33 are set in portrait orientation, which can be obtained as results of the electromagnetic field analysis.

Figure 4A:
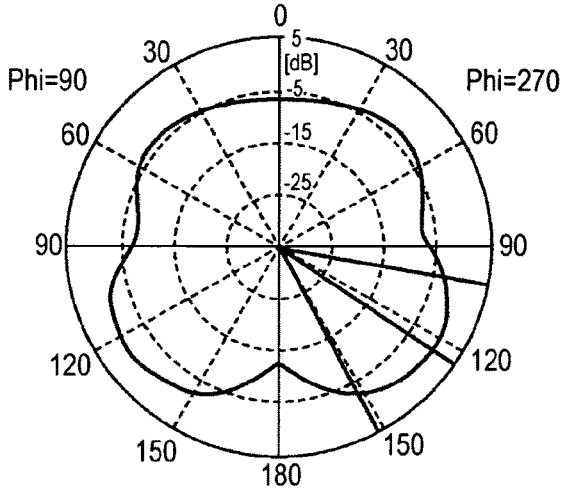
FIG. 4A to FIG. 4C are views showing distribution of irradiation levels within a horizontal surface in the case where the antennas are set in portrait orientation.
Figure 4B:
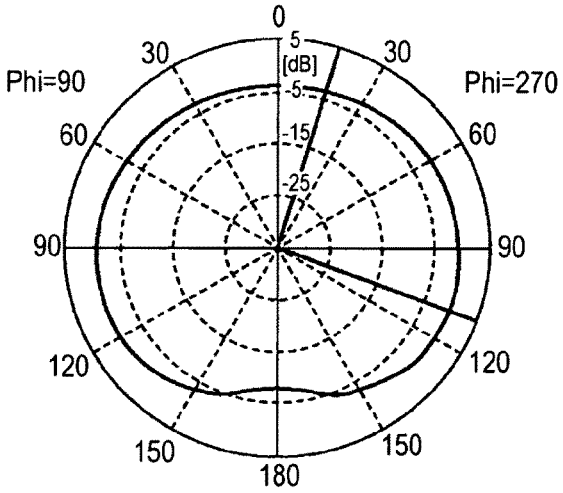
Figure 4C:
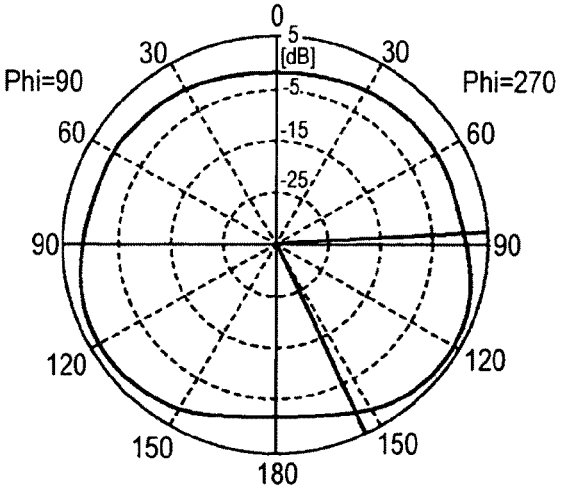

In FIG. 4A to FIG. 4C, angles of a circle indicate irradiation angles of the antenna element 23 within the horizontal surface, and radiuses of the circle indicates irradiation revels at respective irradiation angles. This is the same in FIG. 6A to FIG. 6C which will be described later.

FIG. 4A, FIG. 4B and FIG. 4C respectively show the distribution of irradiation levels as irradiation characteristics of the antenna elements 23 of the antenna 31, antenna 32 and the antenna 33 within the horizontal surface (yz-surface).

In FIG. 4A, the circle indicating the irradiation levels of respective irradiation angles within the horizontal surface is largely distorted, therefore, it can be found that distribution variation of irradiation levels within the horizontal surface is large in the antenna 31.

In FIG. 4B, the distortion of the circle indicating irradiation levels of respective irradiation angles within the horizontal surface is smaller than the case of FIG. 4A, however, distances from the center of the circle to the arc are short as a whole. Therefore, it is found that distribution variation of irradiation levels within the horizontal surface is smaller than the antenna 31 but irradiation levels are small as a whole in the antenna 32.

On the other hand, in FIG. 4C, the distortion of the circle indicating irradiation levels of respective irradiation angles within the horizontal surface is sufficiently small as well as distances from the center of the circle to the arc are long as a whole. Therefore, it is found that distribution variation of irradiation levels within the horizontal surface is sufficiently small as well as the irradiation levels are large as a whole in the antenna 33.

Figure 5:
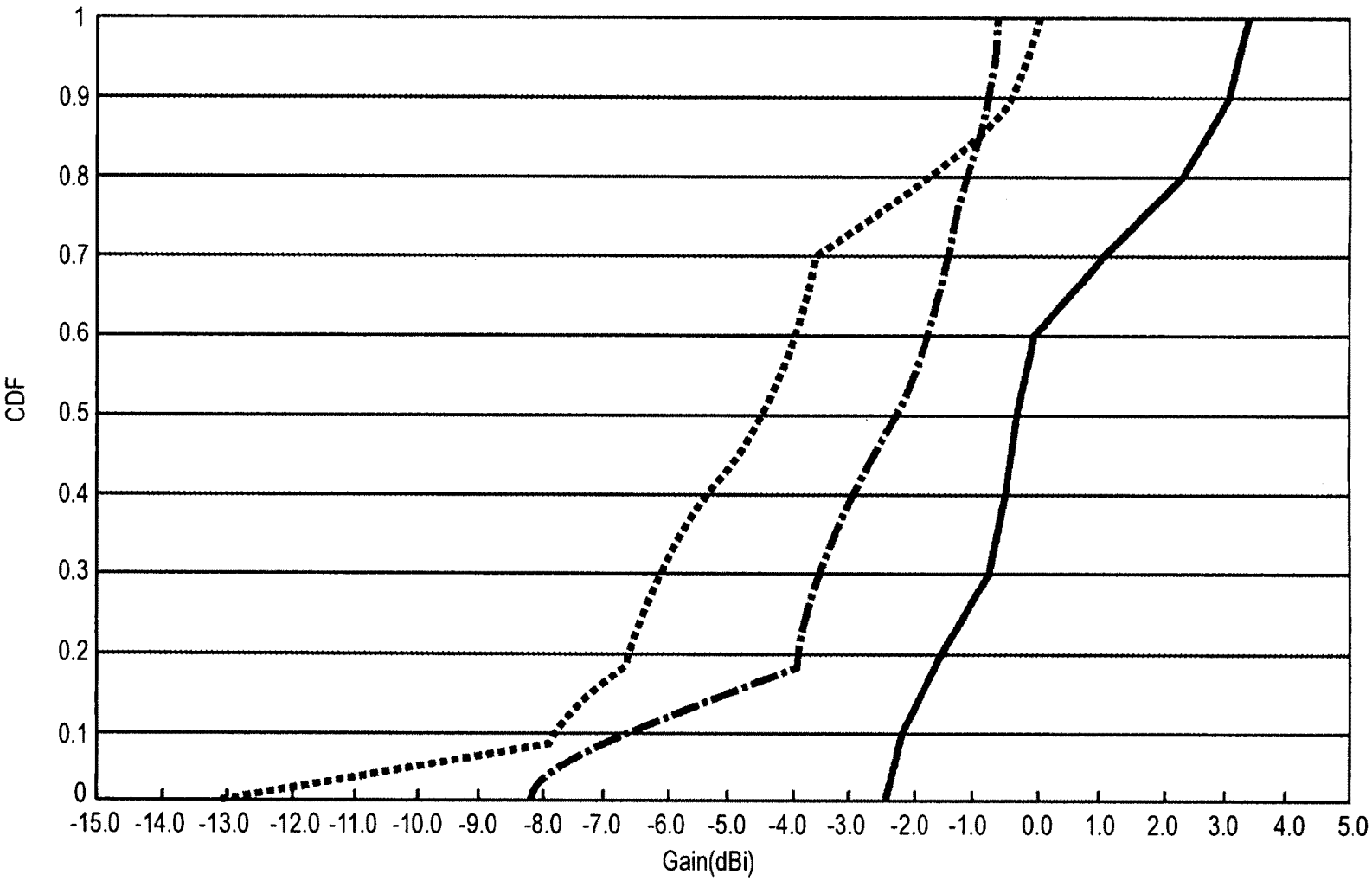
FIG. 5 is a graph showing the relation between the irradiation gain and the cumulative distribution function at respective angles within the horizontal surface in the case where the antennas are set in portrait orientation.

FIG. 5 shows the relation between the irradiation gain and the cumulative distribution function (CDF) at respective angles of the antenna elements 23 within the horizontal surface (yz-surface) in the case where the antennas 31 to 33 are set in portrait orientation, which are obtained as results of the electromagnetic field analysis.

In the graph of FIG. 5, the horizontal axis represents the irradiation gain and the vertical axis represents the cumulative distribution function. A dotted line, a dashed line and a solid line represent the relation of the antenna elements 23 in the antenna 31, the antenna 32 and the antenna 33. This is the same in FIG. 7 which will be described later.

In FIG. 5, it is found that the gradient of the dotted line is small and the distribution variation of irradiation gains within the horizontal surface as irradiation characteristics is large in the antenna 31.

Also in FIG. 5, the gradient of the dashed line is large but the irradiation gains are small as a whole. Therefore, it is found that the distribution variation of the irradiation gains within the horizontal surface is smaller than that of the antenna 31 but irradiation gains are small as a whole in the antenna 32.

On the other hand, the gradient of the solid line in FIG. 5 is large and the irradiation gains are large as a whole. Therefore, it is found that variation of irradiation gains within the horizontal surface is sufficiently small and the irradiation gains are large as a whole in the antenna 33.

As described above, when the antennas 31 to 33 are set in portrait orientation, distribution variation of irradiation characteristics of the antenna element 23 within the horizontal surface is sufficiently small and the irradiation gains are large as a whole in the antenna 33.

FIG. 6A to FIG. 6C and FIG. 7 are views showing distribution of irradiation characteristics of the antenna elements 23 within a horizontal surface (xy-surface) in the case where the antennas 31 to 33 are set in landscape orientation, which can be obtained as results of the electromagnetic field analysis.

Figure 6A:
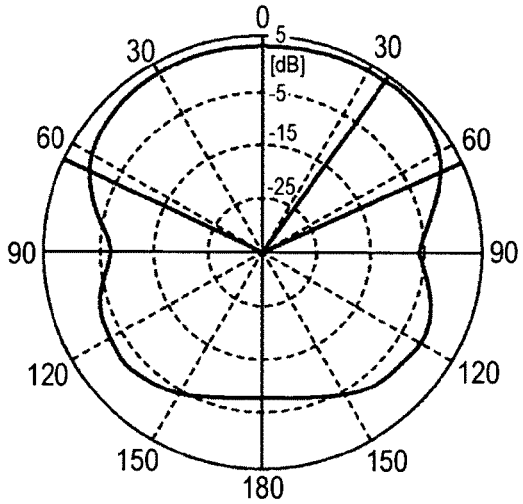
FIG. 6A to FIG. 6C are views showing distribution of irradiation levels within a horizontal surface in the case where the antennas are set in landscape orientation.
Figure 6B:
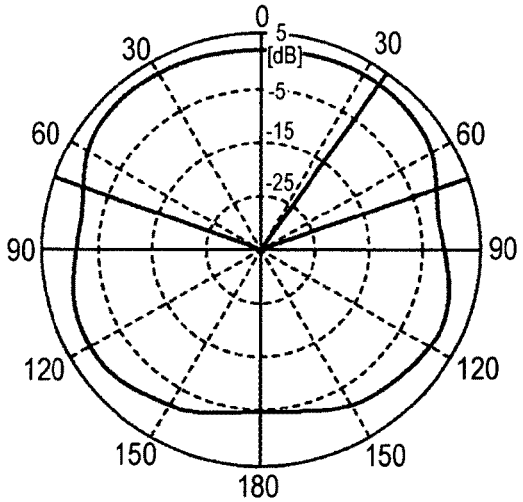
Figure 6C:
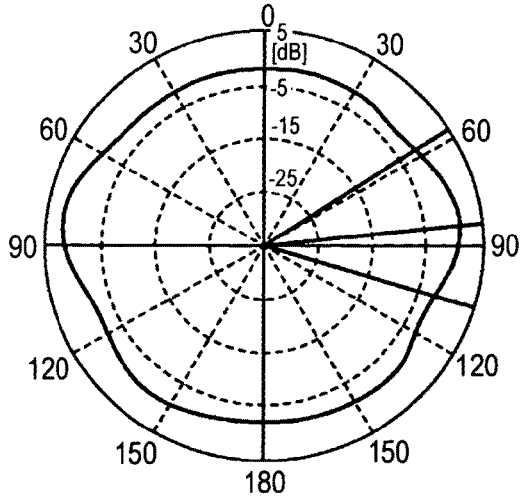

FIG. 6A, FIG. 6B and FIG. 6C respectively show the distribution of irradiation levels as irradiation characteristics of the antenna elements 23 of the antenna 31, antenna 32 and the antenna 33 within the horizontal surface (xy-surface).

In FIG. 6A, the circle indicating the irradiation levels of respective irradiation angles within the horizontal surface is largely distorted, therefore, it can be found that distribution variation of irradiation levels within the horizontal surface is large in the antenna 31.

In FIG. 6C, the distortion of the circle indicating irradiation levels of respective irradiation angles within the horizontal surface is sufficiently small but distances from the center of the circle to the arc are short as a whole. Therefore, it is found that distribution variation of irradiation levels within the horizontal surface is sufficiently small but the irradiation levels are small as a whole in the antenna 33.

On the other hand, in FIG. 6B, the distortion of the circle indicating irradiation levels of respective irradiation angles within the horizontal surface is larger than the case of FIG. 6C, however, distances from the center of the circle to the arc are longer than these of FIG. 6C as a whole. Therefore, it is found that distribution variation of irradiation levels within the horizontal surface is relatively small and irradiation levels are large as a whole in the antenna 32.

Figure 7:
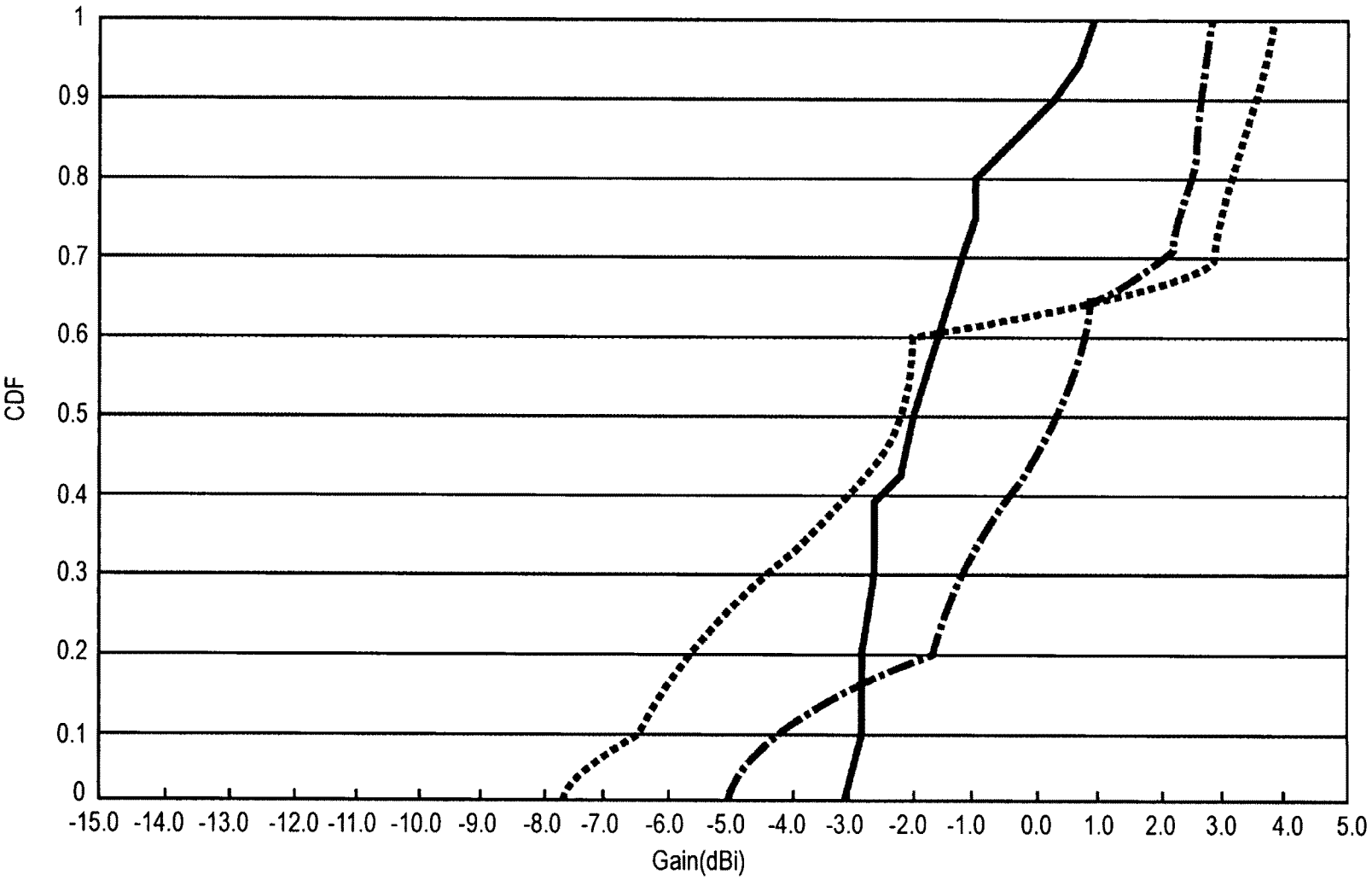
FIG. 7 is a graph showing the relation between the irradiation gain and the cumulative distribution function at respective angles within the horizontal surface in the case where the antennas are set in landscape orientation.

FIG. 7 shows the relation between the irradiation gain and the cumulative distribution function at respective angles of the antenna elements 23 within the horizontal surface (xy-surface) in the case where the antennas 31 to 33 are set in landscape orientation, which are obtained as results of the electromagnetic field analysis.

In FIG. 7, the maximum irradiation gain of a dotted line is large but the gradient is small. Therefore, it is found that the maximum value of the irradiation gain is large but variation of irradiation gains within the horizontal surface is also large in the antenna 31.

Also in FIG. 7, the gradient of a solid line is sufficiently large but the irradiation gains are small as a whole. Therefore, it is found that variation of irradiation gains within the horizontal surface is sufficiently small but the irradiation gains are small as a whole in the antenna 33.

On the other hand, the gradient of a dashed line in FIG. 7 is smaller than the solid line but the irradiation gains are large as a whole. Therefore, it is found that variation of irradiation gains within the horizontal surface is relatively small and the irradiation gains are large as a whole in the antenna 32.

According to the above, when the antennas 31 to 33 are set in landscape orientation, distribution variation of irradiation characteristics of the antenna element 23 within the horizontal surface is relatively small as well as irradiation gains are large as a whole in the antenna 32.

As can be seen from the result of electromagnetic field analysis, the optimum value of the offset "d" is ¼ of the longitudinal length of the bottom plate 21 when the liquid crystal display device 10 is used in portrait orientation, and the optimum value of the offset "d" is ½ of the longitudinal length of the bottom plate 21 when the liquid crystal display device 10 is used in landscape orientation.

However, the liquid crystal display device 10 is used both in portrait orientation and in landscape orientation, therefore, it is necessary to calculate the optimum value of the offset "d" in cases where the device is used in both orientations.

Therefore, in the liquid crystal display device 10, for example, a value whereby distribution variation of irradiation characteristics of the antenna element 23 within the horizontal surface becomes smaller both in cases where the liquid crystal display device 10 is set in portrait orientation and in landscape orientation is calculated as the offset "d".

Specifically, in the above results of electromagnetic field analysis, the antenna having the smallest distribution variation of irradiation characteristics within the horizontal surface both in cases where the liquid crystal display device 10 is set in landscape orientation and in portrait orientation is the antenna 33. Therefore, a value which is ¼ of the longitudinal length of the bottom plate 21 can be calculated as the offset "d". When "d" is calculated to be ¼ of the longitudinal length of the bottom plate 21, the antenna element 23 is offset from the end of the circuit substrate 22 such that the position of the center of the antenna element 23, along the longitudinal direction of the substrate 22, is one quarter of the way from the end of the substrate 22.

The offset "d" is determined in the above manner, thereby reducing distribution variation of irradiation characteristics of the antenna element 23 within the horizontal surface both in cases where the liquid crystal display device 10 is used in portrait orientation and in landscape orientation.

Therefore, the difference of irradiation characteristics in the antenna element 23 in the case where the liquid crystal display device 10 is used in portrait orientation and in the case where it is used in landscape orientation is reduced. Accordingly, it is possible to perform comfortable communication by the liquid crystal display device 10, in which sensitivity does not differ depending on the position of the other party of communication in both orientations of use.

Additionally, n the liquid crystal display device 10, it is also preferable that a value whereby the difference of average values in distribution of irradiation gains within the horizontal surface (hereinafter, referred to as an irradiation gain average difference) in the case where the liquid crystal display device 10 is set in portrait orientation and in the case where it is set in landscape orientation will be smallest is calculated as the offset "d".

Specifically, in the above electromagnetic field analysis, the irradiation gain average difference is, for example, 3.0 dB in the antenna 31, 2.8 dB in the antenna 32 and 1.9 dB in the antenna 33. Therefore, the antenna having the smallest irradiation gain average difference is the antenna 33. Accordingly, a value which is ¼ of the longitudinal length of the bottom plate 21 is calculated as the offset "d".

The offset "d" is determined as described above, thereby reducing the difference of average values in distribution of irradiation gains within the horizontal surface as irradiation characteristics of the antenna element 23 in the case where the liquid crystal display device 10 is used in portrait orientation and in the case where it is used in landscape orientation.

It is further preferable that a value whereby the three-dimensional distribution of irradiation levels of the antenna element 23 in all directions comes close to a true sphere is calculated as the offset "d" in the liquid crystal display device 10.

Figure 8A:
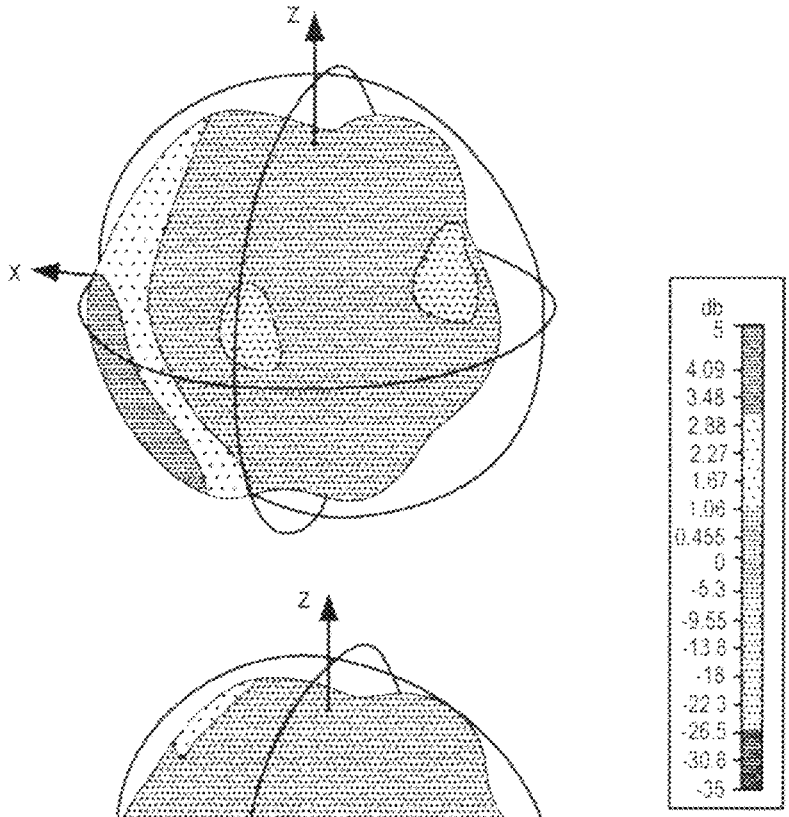
FIG. 8A to FIG. 8C are views showing three-dimensional irradiation levels of antenna elements in all directions.
Figure 8B:
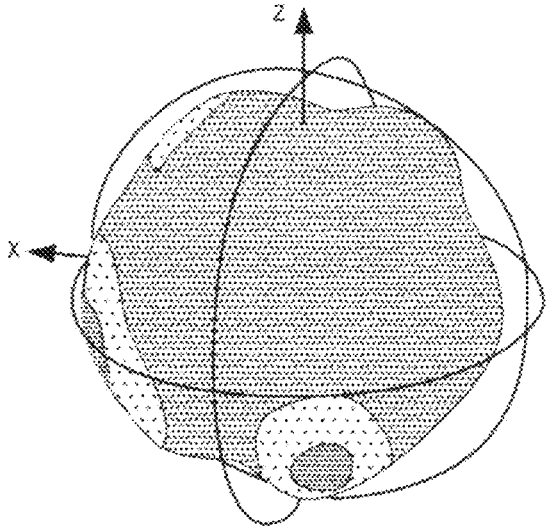
Figure 8C:
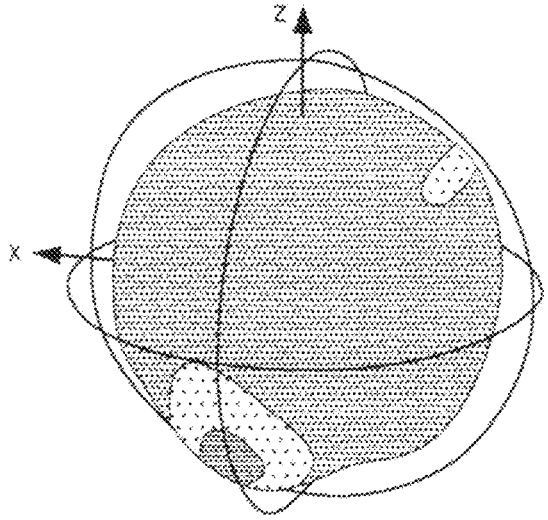

FIG. 8A to FIG. 8C are views showing three-dimensional irradiation levels of antenna elements 23 in all directions in the antennas 31 to 33, which can be obtained as results of the electromagnetic field analysis.

In FIG. 8A to FIG. 8C, angles of the sphere indicate three-dimensional irradiation angles of the antenna element 23, and radiuses of the sphere indicate irradiation levels at respective irradiation angles.

FIG. 8A, FIG. 8B and FIG. 8C indicates three-dimensional distribution of irradiation levels in all directions as irradiation characteristics of the antenna elements 23 in the antenna 31, the antenna 32 and the antenna 33 respectively.

In FIG. 8A and FIG. 8B, spheres indicating irradiation levels of three-dimensional respective irradiation angles are distorted, and it is found that the difference of three-dimensional distribution of irradiation levels in all directions in portrait orientation and in landscape orientation is large in the antennas 31, 32.

On the other hand, in FIG. 8C, there are just a few directions in which irradiation levels are locally strong or locally weak (null), and the sphere indicating irradiation levels of three-dimensional respective irradiation angles is close to the true sphere. Therefore, it is found that the difference of three-dimensional distribution of irradiation levels in all directions in the case of the portrait orientation and in the case of the horizontal orientation is small in the antenna 33.

Accordingly, the antenna in which the three-dimensional distribution of irradiation levels of the antenna element 23 in all directions is closest to the true sphere is the antenna 33, therefore, a value which is ¼ of the longitudinal length of the bottom plate 21 is calculated as the offset "d.

The offset "d" is determined in the above manner, thereby reducing the difference in three-dimensional distribution of irradiation levels in all directions as irradiation characteristics of the antenna element 23 in cases where the liquid crystal display device 10 is used in portrait orientation and in landscape orientation.

As described above, when the offset "d" is calculated so that the difference of irradiation characteristics in the case where the liquid crystal display device 10 is set in portrait orientation and in the case where it is set in landscape orientation is reduced, the user can perform comfortable wireless communication without feeling the difference in performance of the wireless communication function both in cases where the liquid crystal display device is used in portrait orientation and in the landscape orientation.

Next, the reason why the difference of irradiation characteristics occurs due to the arrangement of the antenna element 23 will be explained with reference to FIG. 9A to FIG. 9C.

Figure 9A:
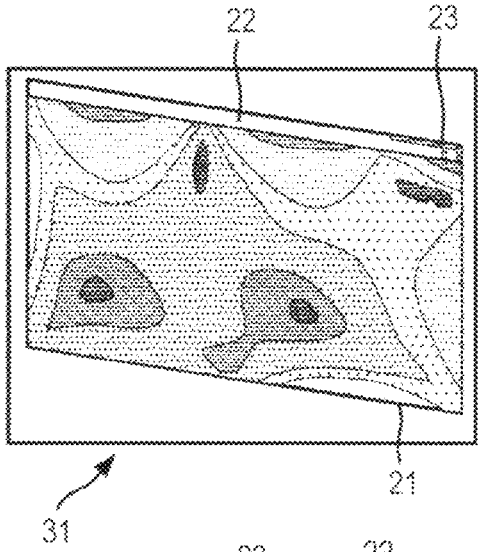
FIG. 9A to FIG. 9C are views explaining the reason why the difference of irradiation characteristics occurs.
Figure 9B:
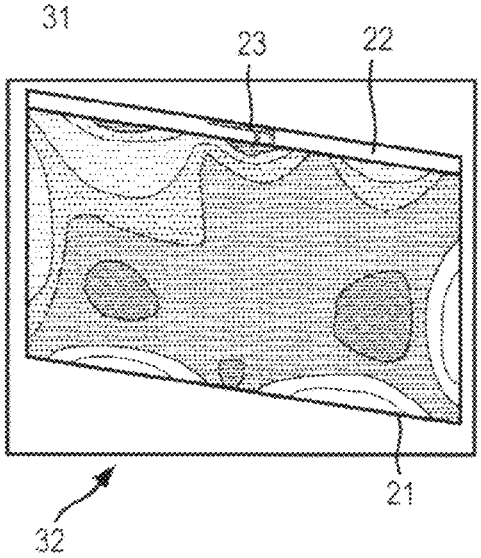
Figure 9B:
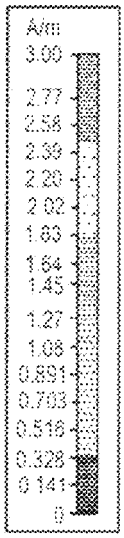
Figure 9C:
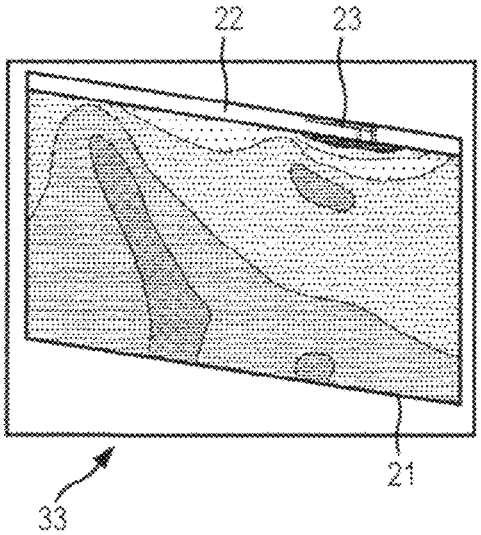

FIG. 9A, FIG. 9B and FIG. 9C show distributions of electric current flowing in the antenna element 23 and the bottom plate 21 at the time of wireless communication in the antenna 31, the antenna 32 and the antenna 33 respectively.

In FIG. 9A and FIG. 9B, distribution of strong electric current exists at circumferential portions of the bottom plate 21. Therefore, it can be considered that directions in which irradiation levels are locally strong or locally weak appear a lot due to strong electric current flowing at circumferential portions of the bottom plate 21 in the antennas 31, 32.

On the other hand, there does not exist distribution of strong electric current at circumferential portions of the bottom plate 21 in FIG. 9C, therefore, it can be considered that there are few directions in which irradiation levels are locally strong or locally weak in the antenna 33.

In the above description, the offset "d" can be calculated by performing the electromagnetic field analysis of the antenna which exists by itself. However, irradiation characteristics differ depending on the shape or materials of the casing 11, interference with respect to other electrical components included in the liquid crystal display 10 and the like, therefore, the offset "d" can be calculated by performing electromagnetic field analysis of the antenna in consideration of these conditions. In this case, a more accurate offset "d" can be calculated.

Additionally, the antenna element 23 resonates at a single frequency in the above explanation, however, it is also preferable that the antenna element 23 resonates at plural frequencies.

In this case, when the antenna element 23 resonates at respective frequencies in plural frequencies, the offset "d" is calculated so that distribution variation of irradiation characteristics of the antenna element 23 within the horizontal surface is reduced in both cases where the liquid crystal display device 10 is set in portrait orientation and in landscape orientation.

Additionally, when the antenna element 23 resonates at respective frequencies in plural frequencies, the offset "d" is calculated so that irradiation gain average difference in the cases where the liquid crystal display device 10 is set in portrait orientation and in landscape orientation is reduced. Also when the the antenna element 23 resonates at respective frequencies in plural frequencies, the offset "d" is calculated so that three-dimensional distribution of irradiation levels of the antenna element 23 in all directions comes close to a true sphere.

The shape of the casing 10 is not limited to a rectangular parallelepiped shape but, for example, a cubic shape can be applied.

The invention can be applied to electronic devices which can be used both in portrait orientation and in landscape orientation.

The embodiments of the invention are not limited to the above-described embodiment and various modifications can be made within the range not departing from the gist of the invention.

What is claimed is:

1. An electronic device comprising:

a liquid crystal display;

a circuit substrate; and an antenna element installed on the circuit substrate, the antenna element included in the liquid crystal display, wherein the antenna element is installed at a position apart from an end of the circuit substrate by a given offset so that distribution variation of irradiation characteristics of the antenna element within a horizontal surface is reduced both in cases where the electronic device in which the antenna element is installed is set in portrait orientation and in landscape orientation, in which display on the liquid crystal display is performed by the electronic device so that the display is viewed by a user in accordance with a normal position when the electronic device is set in the portrait and landscape orientations, wherein the antenna element is included in an antenna that includes a bottom plate, the bottom plate being incorporated within the liquid crystal display, and the antenna element being offset from the end of the bottom plate such that the position of the center of the antenna element, along the longitudinal direction of the bottom plate, is one quarter of the way from the end of the bottom plate.

2. The electronic device according to claim 1, wherein the antenna element is a monopole antenna, a reverse F-type antenna, a reverse L-type antenna, a folded monopole antenna or a slot antenna.

3. The electronic device according to claim 1, wherein the antenna element resonates at plural frequencies.

4. The electronic device according to claim 3, wherein the antenna element is installed at a position apart from the end of the circuit substrate by the given offset so that distribution variation of irradiation characteristics within the horizontal surface is reduced both in cases where the electronic device is set in portrait orientation and in landscape orientation when the antenna element resonates at respective frequencies in the plural frequencies.

5. An electronic device comprising:

a liquid crystal display;

a circuit substrate; and an antenna element installed on the circuit substrate, the antenna element included in the liquid crystal display, wherein the antenna element is installed at a position apart from an end of the circuit substrate by a given offset so that the difference of average values in distribution of irradiation characteristics of the antenna element within a horizontal surface is reduced in cases where the electronic device in which the antenna element is installed is set in portrait orientation and in landscape orientation, in which display on the liquid crystal display is performed by the electronic device so that the display is viewed by a user in accordance with a normal position when the electronic device is set in the portrait and landscape orientations, wherein the antenna element is included in an antenna that includes a bottom plate, the bottom plate being incorporated within the liquid crystal display, and the antenna element being offset from the end of the bottom plate such that the position of the center of the antenna element, along the longitudinal direction of the bottom plate, is one quarter of the way from the end of the bottom plate.

6. The electronic device according to claim 5, wherein the antenna element is a monopole antenna, a reverse F-type antenna, a reverse L-type antenna, a folded monopole antenna or a slot antenna.

7. The electronic device according to claim 5, wherein the antenna element resonates at plural frequencies.

8. The electronic device according to claim 7, wherein the antenna element is installed at a position apart from the end of the circuit substrate by the given offset so that the difference of average values in distribution of irradiation characteristics within the horizontal surface is reduced in cases where the electronic device is set in portrait orientation and in landscape orientation when the antenna element resonates at respective frequencies in the plural frequencies.

9. An electronic device comprising:

a liquid crystal display;

a circuit substrate; and an antenna element installed on the circuit substrate, the antenna element included in the liquid crystal display, wherein the antenna element is installed at a position apart from an end of the circuit substrate by a given offset so that distribution of irradiation characteristics of the antenna element in all directions comes close to a true sphere, in which display on the liquid crystal display is performed by the electronic device so that the display is viewed by a user in accordance with a normal position when the electronic device is set in the portrait and landscape orientations, wherein the antenna element is included in an antenna that includes a bottom plate, the bottom plate being incorporated within the liquid crystal display, and the antenna element being offset from the end of the bottom plate such that the position of the center of the antenna element, along the longitudinal direction of the bottom plate, is one quarter of the way from the end of the bottom plate.

10. The electronic device according to claim 9, wherein the antenna element is a monopole antenna, a reverse F-type antenna, a reverse L-type antenna, a folded monopole antenna or a slot antenna.

11. The electronic device according to claim 9, wherein the antenna element resonates at plural frequencies.

12. The electronic device according to claim 11, wherein the antenna element is installed at a position apart from the end of the circuit substrate by the given offset so that distribution of irradiation characteristics in all directions comes close to a true sphere when the antenna element resonates at respective frequencies in the plural frequencies.

* * * * *